US005609413A

United States Patent [19]

Lecluze

[11] Patent Number: 5,609,413

[45] Date of Patent: Mar. 11, 1997

[54] ADJUSTABLE LIGHT FIXTURE

[75] Inventor: Michel Lecluze, St-Nicolas, Canada

[73] Assignee: Eclairage Contraste, St-Jean-Chrysostome, Canada

[21] Appl. No.: 599,658

[22] Filed: Feb. 12, 1996

[51] Int. Cl.[6] ..... F21S 1/06

[52] U.S. Cl. ..... 362/364; 362/269; 362/285; 362/371; 362/426

[58] Field of Search ..... 362/324, 282, 362/285, 283, 269, 371, 275; 248/342, 343, 344

[56] References Cited

U.S. PATENT DOCUMENTS

| | | | |
|---|---|---|---|
| 1,210,146 | 12/1916 | Canfield | 362/426 |
| 2,166,394 | 7/1939 | Crossley | 362/371 |
| 2,224,225 | 12/1940 | Holroyd | 362/275 |
| 2,426,093 | 8/1947 | Hardman | 362/269 |
| 3,337,724 | 8/1967 | Deflandre | 240/2 |
| 3,609,346 | 9/1971 | Lund et al. | 240/41.6 |
| 3,974,371 | 8/1976 | Miles, Jr. | 240/41.6 |
| 4,173,037 | 10/1979 | Henderson, Jr. et al. | 362/287 |
| 4,232,361 | 11/1980 | Kelsall | 362/285 |
| 4,504,888 | 3/1985 | Rosenthal | 362/371 |
| 4,518,896 | 5/1985 | Miles, Jr. | 315/162 |
| 4,623,956 | 11/1986 | Conti | 362/148 |
| 4,712,168 | 12/1987 | Scherrer | 362/427 |
| 4,862,336 | 8/1989 | Richardson et al. | 362/285 |
| 4,881,157 | 11/1989 | Pahl | 362/371 |
| 5,130,914 | 7/1992 | Bengochea | 362/364 |
| 5,145,249 | 9/1992 | Bruckner | 362/365 |
| 5,291,381 | 3/1994 | Price | 362/366 |

FOREIGN PATENT DOCUMENTS

| | | |
|---|---|---|
| 449505 | 6/1948 | Canada . |
| 547770 | 10/1957 | Canada . |
| 652247 | 3/1929 | France . |
| 1230183 | 9/1960 | France . |
| 1268272 | 6/1961 | France . |
| 687792 | 2/1953 | United Kingdom . |

*Primary Examiner*—James C. Yeung
*Attorney, Agent, or Firm*—Quarles & Brady

[57] ABSTRACT

The disclosure herein describes an adjustable light fixture recessed in a ceiling or wall for directing light at various angles and including, within a hollow elongated housing, a pair of inverted U-shaped members pivotally mounted to one another about a horizontal axis. The assembly of the two U-shaped members may be further pivoted about a central vertical axis so that a light bulb and socket mounted in one of the U-shaped member may be angularly adjusted about two axes to provide light at various angles of illumination.

6 Claims, 2 Drawing Sheets

ADJUSTABLE LIGHT FIXTURE

FIELD OF THE INVENTION

The present invention relates to a light fixture which is recessed in a ceiling or wall and which is adjustable for directing light at various angles of illumination.

BACKGROUND OF THE INVENTION

There are various types of light fixtures which are mounted in a ceiling or a wall and are adjustable to illuminate a desired area of a room. Some are recessible so that they may be moved in and out of their housing so that the light bulb, once partially out of the housing, may adopt various positions for a variety of illumination. One such adjustable light fixture may be found described in U.S. Pat. No. 4,232,361 issued Nov. 4, 1980 to Kelsall. Another adjustable light fixture is found described in U.S. Pat. No. 3,974,371 bearing an issue date of Aug. 10, 1976 in the name of Miles. The light fixture described in the latter patent comprises many components, such as a yoke member for supporting a reflector and extensible mounting means that include toggle levers, a pair of brackets and fastening members resulting in a complex configuration due particularly to the fact that the light fixture is vertically retractable in and out the housing.

OBJECTS AND STATEMENT OF THE INVENTION

It is an object of the present invention to provide a simple adjustable light fixture that is permanently recessed in a ceiling or wall for directing light at various angles, thus without the need to retract the fixture out of the housing in order to provide illumination.

This is achieved by providing a light fixture which comprises:

- a hollow elongated housing having an open end and a closed end;
- a first inverted-U shaped member having a top portion rotatably mounted to the closed end of the housing and a pair of downwardly extending leg portions having lower extremities;
- a second inverted-U shaped member mounted within the top and leg portions of the first member; the second member having a top portion and a pair of downwardly extending leg portions pivotally mounted at their respective lower extremities to the lower extremities of the first member whereby the second member may be pivoted about a horizontal axis to adopt various positions relative thereto and within the first member;
- a light socket for receiving a light bulb fixedly secured to the top portion of the second member;
- pivot means in the top portion of the first member allowing rotation of the first member relative to the housing about a vertical axis extending centrally through the housing whereby the light socket may be pivoted about the horizontal and vertical axes to provide a light bulb with various angles of illumination; and
- means for fixing the first member to the housing after rotational adjustment of the first member relative to the housing.

In one form of the invention, the light fixture comprises friction means between the leg portions of the first and second members to provide some resistance to the pivotal movement of the second member relative to the first member and also to assist in maintaining the second member in position relative to the first member after a pivotal movement.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
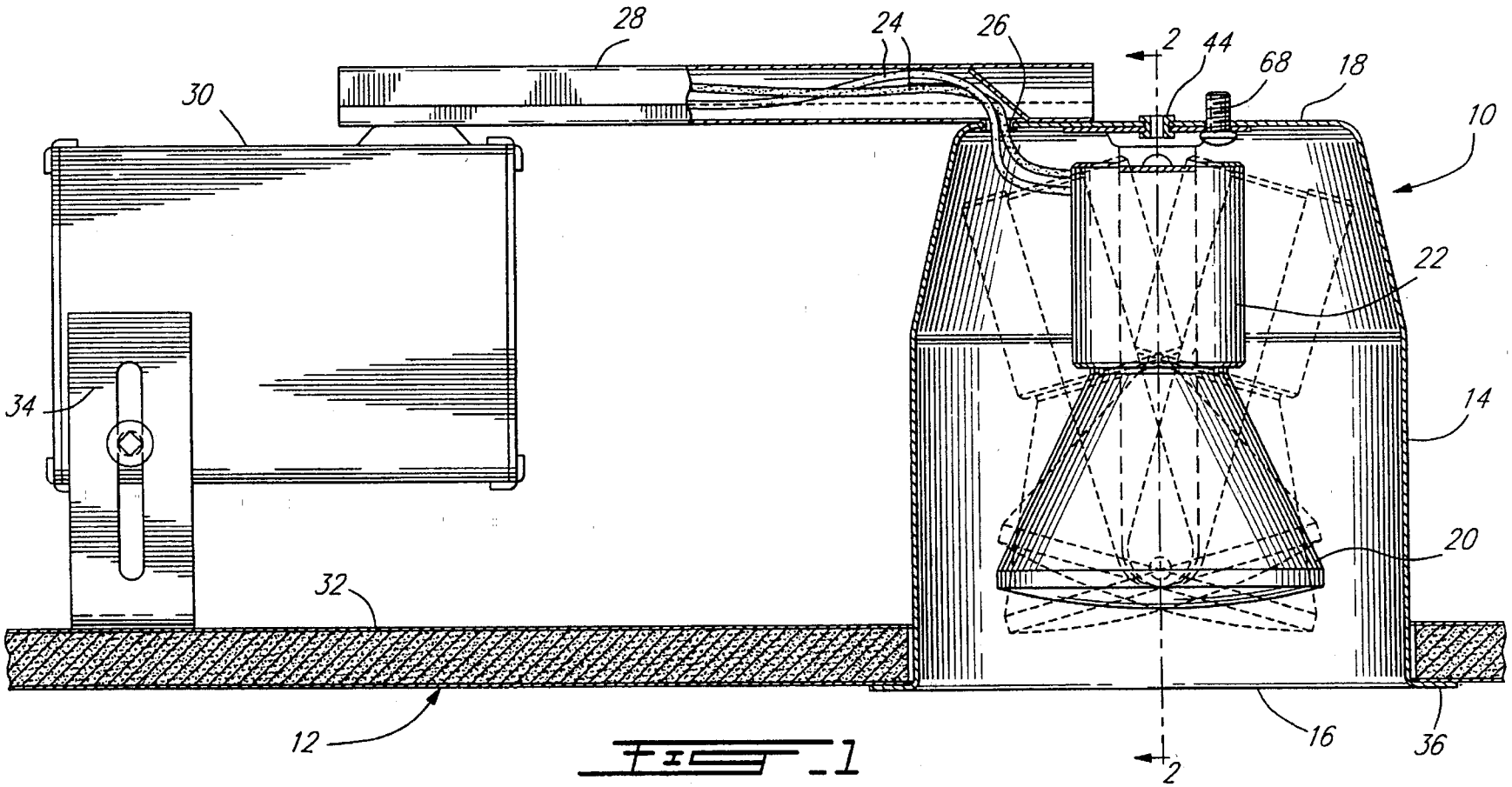
FIG. 1 is a partly sectional elevation of an adjustable light fixture made in accordance with the present invention and shown recessed in a ceiling or a wall tile.

Referring to FIG. 1, there is shown an adjustable light fixture, generally denoted 10, which is shown mounted within an opening made in a ceiling or wall tile 12. The fixture comprises a housing 14 which is recessed relative to the tile and includes an open end 16 and a closed end 18. Within the housing 14 is an electric light bulb 20 threadedly engaged into a socket 22 from which extends a pair of wires 24 passing through an opening 26 to be receive in an elongated channel member 28 and in a junction box 30; the latter is adjustably mounted to the rear face of the ceiling tile by means of an appropriate bracket assembly 34. The housing 14 has a flange portion 36 that bears against the front face of the ceiling tile 12.

Figure 2:
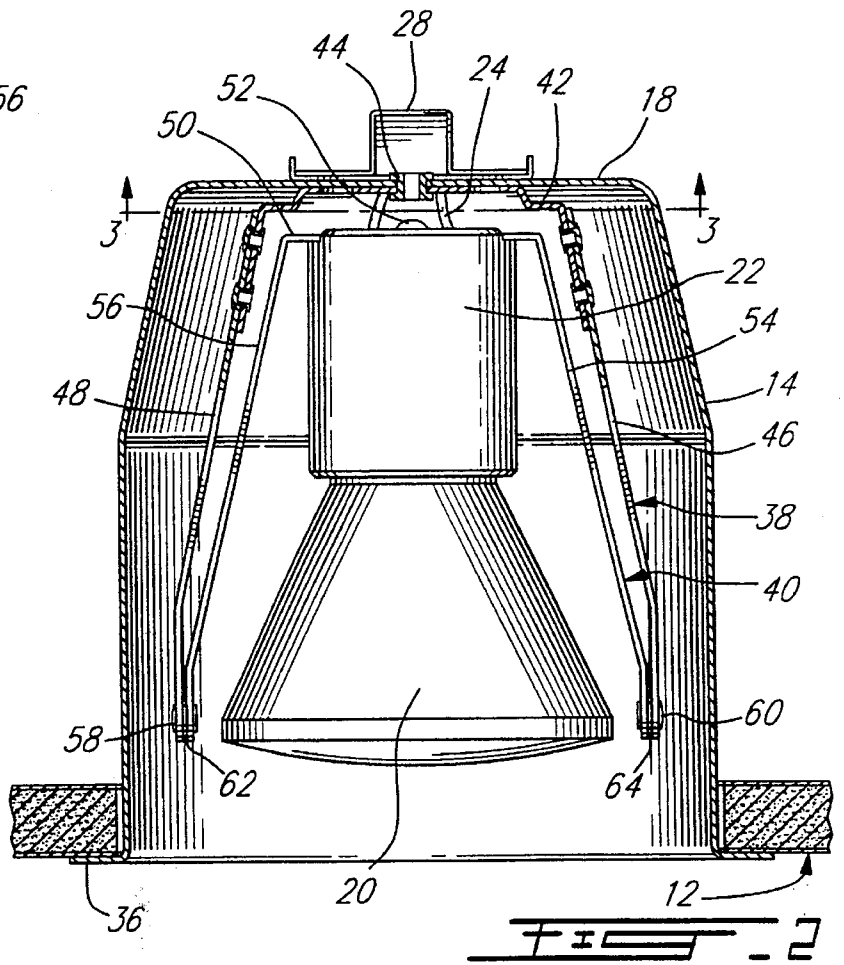
FIG. 2 is a cross sectional view taken along lines 2—2 of FIG. 1.

Referring to FIG. 2, the light fixture further includes a pair of inverted U-shaped members, generally denoted 38 and 40.

The first inverted U-shaped member 38 has a top part 42 which is mounted to contact the inner face of the closed end 18 of the housing and is secured thereto by means of a rivet 44 which enables the inverted U-shaped member 38 to be rotated about a vertical axis extending centrally of the housing through the rivet. The inverted U-shaped member 38 also includes a pair of downwardly extending legs 46 and 48 terminating adjacent the lower part of the light bulb 20.

Figure 4:
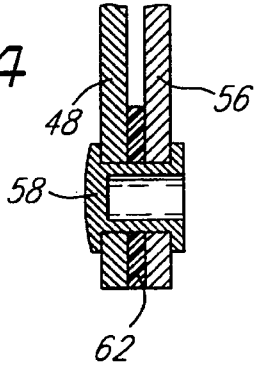
FIG. 4 is an enlarged section of the connection of the leg members.

The second inverted U-shaped member 40 includes a top portion 50 to which is fixedly secured the light socket 22 by means of a screw 52. This second U-shaped member also includes a pair of opposite downwardly extending leg portions 54 and 56, the lower extremities of which terminate adjacent the lower extremities of the leg portions 46 and 48 of the U-shaped member 38. As can be seen in FIGS. 2 and 4, the lower extremities of the leg portions 48 and 56 and of leg portions 40 and 46 are connected by means of rivets 58 and 60, respectively, so as to define a common horizontal axis about which the inverted U-shaped member 40 may pivot as well as the bulb and socket assembly. In order to provide some resistance to this pivotal movement and to maintain the pivoted member in the desired pivoted position, a frictional element 62 is provided between the inner faces of the two extremities of the leg portions 48, 56; a similar friction element 64 is provided between the leg portions 40 and 46 at their lower extremities. One preferred form of such a friction element is a fiber washer.

Figure 3:
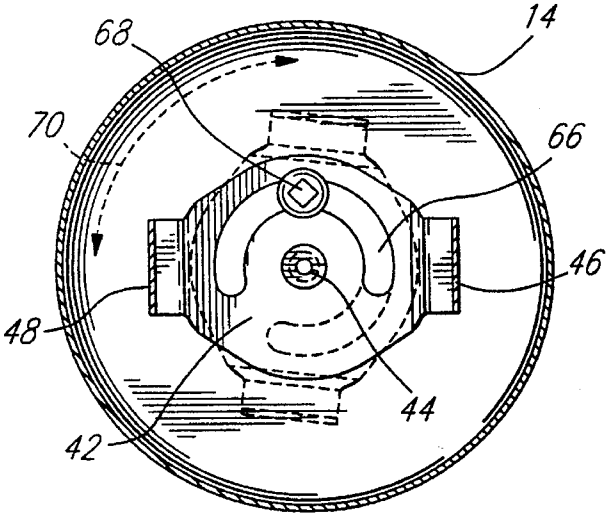
FIG. 3 is a cross sectional view taken along lines 3—3 of FIG. 2.

Referring to FIG. 3, the top part 42 of the first inverted U-shaped member has an arc-shaped slot 66 through which extends a tightening screw 68, which also extends through a corresponding hole in the closed end 18 of the housing. Hence, by slightly unscrewing the screw 68, the inverted U-shaped member 38 may be rotated about the vertical axis extending through the rivet 44 (as indicated by arrow 70) to thereby provide various positions as shown by the dotted lines in FIG. 3. Once the desired position is obtained, screw 68 is tightened and, thereafter, the light bulb with its socket and its inverted U-shaped supporting member 40 may be pivoted about the horizontal axis extending through the rivets 58 and 60 to provide various angular positions shown in dotted lines of FIG. 1.

Therefore, both pivot axes (vertical and horizontal) allow the light bulb to provide a variety of illumination angles. All angles are possible if the arc-shaped slot 66 is at least 180°.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. An adjustable light fixture recessed in a ceiling for directing light at various angles comprising:

a hollow elongated housing having an open end and a closed end;

a first inverted-U shaped member having a top portion rotatably mounted to said closed end and a pair of downwardly extending leg portions having lower extremities wherein said top portion of said first member defines an arc-shaped slot;

a second inverted-U shaped member mounted within said top and leg portions of said first member; said second member having a top portion and a pair of downwardly extending leg potions pivotally mounted at their respective lower extremities to the lower extremities of said first member whereby said second member may be pivoted about a horizontal axis to adopt various positions relative thereto and within said first member;

a light socket for receiving a light bulb fixedly secured to said top portion of said second member;

pivot means in said top portion of said first member allowing rotation of said first member relative to said housing about a vertical axis extending centrally through said housing whereby the light socket may be pivoted about said horizontal and vertical axes to provide a light bulb with various angles of illumination; and means for fixing said first member to said housing after rotational adjustment of said first member relative to said housing wherein said fixing means extends through said slot and through said closed end of said housing.

2. An adjustable light fixture as defined in claim 1, further comprising friction means between said leg portions of said first and second members to provide resistance to pivotal movement of the second member relative to the first member and to assist in maintaining said second member in position relative to the first member after said pivotal movement.

3. An adjustable light fixture as defined in claim 2, wherein said friction means consist of a fiber washer contained between the lower extremities of the leg portions of the first and second members.

4. An adjustable light fixture as defined in claim 1, wherein said pivot means consist of a rivet connecting said top part of said first member to said closed end of said housing.

5. An adjustable light fixture as defined in claim 1, wherein said fixing means consist of an indexing screw.

6. An adjustable light fixture as defined in claim 1, wherein said slot defines an arc of at least 180°.

* * * * *